US005632322A

United States Patent [19]

Trickel et al.

[11] Patent Number: 5,632,322

[45] Date of Patent: May 27, 1997

[54] DIE CASTING APPARATUS FOR CASTING SMALL PARTS FROM MATERIALS THAT EXPAND WHEN TRANSITIONING FROM THE LIQUID TO THE SOLID STATE

[76] Inventors: Jerry E. Trickel, 5010 Mohawk Ct., Granbury, Tex. 76049; Lyn O. Trickel, 10816 Camellia, Dallas, Tex. 75230

[21] Appl. No.: 617,485

[22] Filed: Mar. 15, 1996

Related U.S. Application Data

[62] Division of Ser. No. 509,168, Jul. 31, 1995.

[51] Int. Cl.[6] ..... B22D 17/04; B22D 17/22

[52] U.S. Cl. ..... 164/316; 164/312

[58] Field of Search ..... 164/316, 317, 164/318, 312

[56] References Cited

U.S. PATENT DOCUMENTS

| | | | |
|---|---|---|---|
| 1,746,236 | 2/1930 | Barton | 164/129 |
| 2,004,959 | 6/1935 | Morin et al. | 164/316 X |
| 2,209,502 | 7/1940 | Annich | 29/527.6 |

FOREIGN PATENT DOCUMENTS

| | | | |
|---|---|---|---|
| 1193645 | 5/1965 | Germany | 164/129 |
| 57-44449 | 3/1982 | Japan | 164/129 |
| 57-50268 | 3/1982 | Japan | 164/76.1 |
| 58-77767 | 5/1983 | Japan | 164/129 |
| 59-42167 | 3/1984 | Japan | 164/129 |

*Primary Examiner*—J. Reed Batten, Jr.

*Attorney, Agent, or Firm*—Max Ciccarelli; Kenneth C. Hill

[57] ABSTRACT

The die has first and second die halves, each die half having a plurality of cavities that, when the die halves are in a closed position, align with the cavities in the other die half, thus defining a plurality of voids that define the objects to be formed. Each cavity is aspherical in that the slope of the cavity is never perpendicular to the front surface of the die half, thus facilitating the removal of the objects from the die. A spacing between the front surfaces of the die halves during the injection step of the cycle helps to increase the number of parts that properly release from the die.

12 Claims, 3 Drawing Sheets

DIE CASTING APPARATUS FOR CASTING SMALL PARTS FROM MATERIALS THAT EXPAND WHEN TRANSITIONING FROM THE LIQUID TO THE SOLID STATE

This application is a division of application Ser. No. 08/509,168, filed Jul. 31, 1995.

BACKGROUND OF THE INVENTION

1. Field of the Invention

This invention relates in general to die casting of small parts, and in particular to die casting of small parts made of materials that expand when transition lug from the liquid to the solid state, such as bismuth alloys.

2. Description of the Prior Art

Die casting of small parts from materials such as lead, zinc and tin is well known in the art. Equipment and methods for casting such materials are well known and in widespread use.

There are several types of traditional die casting machines, with hot-chamber machines being popular for die casting small parts. Generally, the die comprises two die halves, a stationary die half and movable die half. Either one or both of the die halves have cavities located therein, which, when the die halves are in the closed position, define the shape of the cast part. To cast a part, the die halves are locked in the closed position, and the molten material is injected into the cavities. After a cooling period, the die halves are separated, and the part is ejected from the die. In order to have proper ejection, it is desirable for the parts to partially stick to the movable die half. This is so because only the movable die half usually has ejection pins. Thus, if parts stick to the stationary die half, they would have to be manually removed, thus preventing the automation of the casting process.

Standard die casting equipment and methods are well suited for use in conjunction with standard die casting materials. However, when standard equipment and methods are used with materials that expand in transitioning between the liquid state and solid state, the standard equipment has been found to be far from adequate. The parts being die cast stick to the wrong side of the die and do not properly release from the die, thus making the casting of parts very inefficient, if not impossible.

The need to die cast small parts out of a material that expands during solidification has only recently become a concern. The recent introduction of shotgun shells comprising pellets, or shot, made from bismuth alloys has begun the search for a technique for forming shot out of bismuth alloys. Bismuth, however, expands when transitioning from the liquid to the solid state, and alloys comprising bismuth generally have the same tendency. Experimentation has revealed that standard die casting equipment and methods do not work with materials that expand upon solidification, including bismuth alloys.

The need exists for an apparatus and process for efficiently die casting small parts from materials that expand when transitioning from the liquid to the solid state.

It is the general object of the invention to provide an apparatus and a process for efficiently die casting small parts from materials that expand when transitioning from the liquid to the solid state.

The present invention is for a die for die casting substantially spherical objects of a material that expands when transitioning from the liquid to the solid state, and an associated method of casting such parts. The die comprises a first and second die halves, each die half having a plurality of cavities that, when the die halves are in a closed position, align with the cavities in the other die half, thus defining a plurality of voids that define the objects to be formed. Each cavity is aspherical in that the slope of the cavity is never perpendicular to the front surface of the die insert, thus facilitating the removal of the objects from the die. A spacing between the front surfaces of the die halves during the injection step of the cycle helps to increase the number of parts that properly release from the die.

The above as well as additional objects, features, and advantages will become apparent in the following description.

BRIEF DESCRIPTION OF THE DRAWINGS

In FIGS. 1A and 1C, the die halves are shown in the open position, and in FIG. 1B, the die halves are shown in the closed position.

DETAILED DESCRIPTION OF THE INVENTION

In the preferred embodiment, the invention is used in conjunction with a Horla 250 Mini Die Caster, available through Die Tech Industries, Ltd., of Providence, R.I. The present invention can be used to cast parts, or objects, of various shapes and sizes, but is described herein in conjunction with spherical parts having a diameter of 0.180 inches, which corresponds to shot of "00" or "BB" size.

Figure 1A:
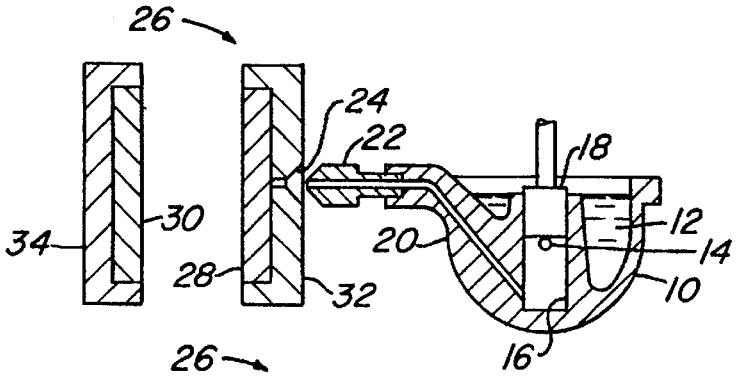
FIGS. 1A–1C are cross sectional schematic views of portion of the die-casting machine for use with the present invention.
Figure 1B:
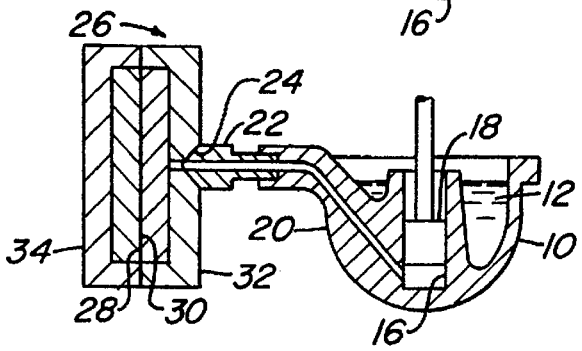
Figure 1C:
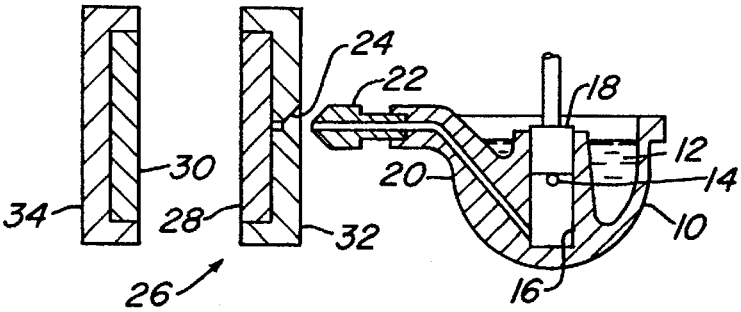

FIGS. 1A–1C are schematics of portion of the die-casting machine. Melting pot 10 holds the molten metal 12. Port 14 allows molten metal 12 to enter into cylinder 16. A 1.25 inch diameter plunger 18 travels through cylinder 16. On the downward portion of the stroke, plunger 18 forces molten metal through the gooseneck 20, the nozzle 22, the sprue bushing 24, and into the mold cavities (not shown in the schematics of FIGS. 1A–1C). On the upward portion of the stroke, plunger 18 draws molten metal from melting pot 10 into cylinder 16.

Also shown in the schematics of FIGS. 1A–1C is die 26. Die 26 comprises stationary die half 28 and the movable die half 30. The die halves 28, 30 are supported by die bases, or platens 32, 34. The die halves 28, 30 and platens 32, 34 move between an open position shown in FIGS. 1A and 1C, and a closed position shown in FIG. 1B. Ejection pins are not shown in FIGS. 1A–1C, but are well known to persons skilled in the art. The die cavities are also not shown in the schematics of FIGS. 1A–1C, and are described in more detail below.

Figure 2A:
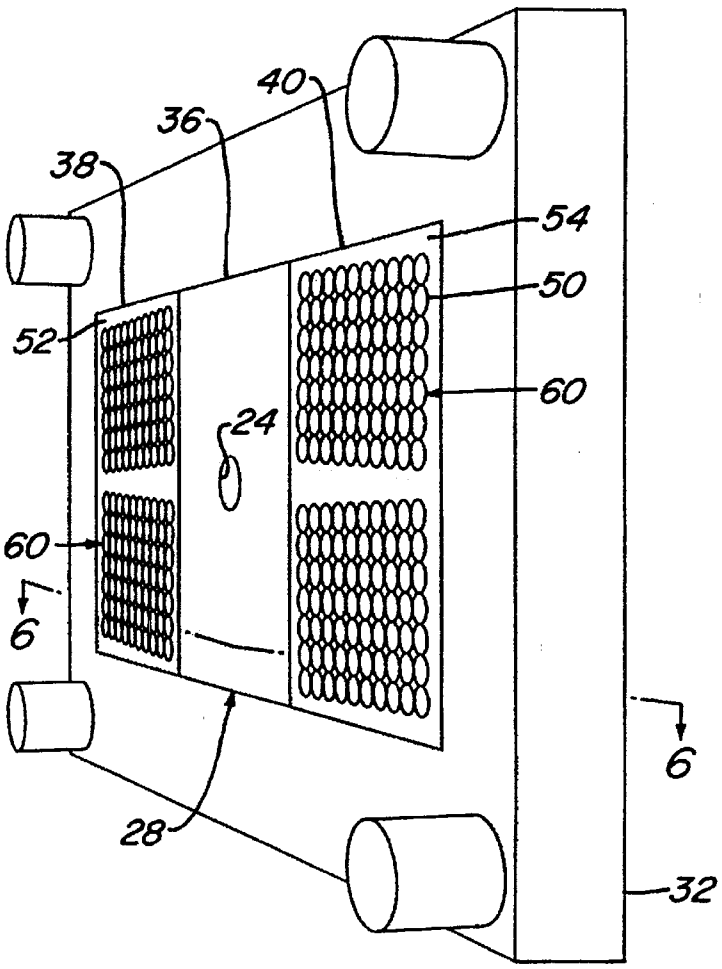
FIGS. 2A and 2B are perspective views of the die halves of the present invention.
Figure 2B:
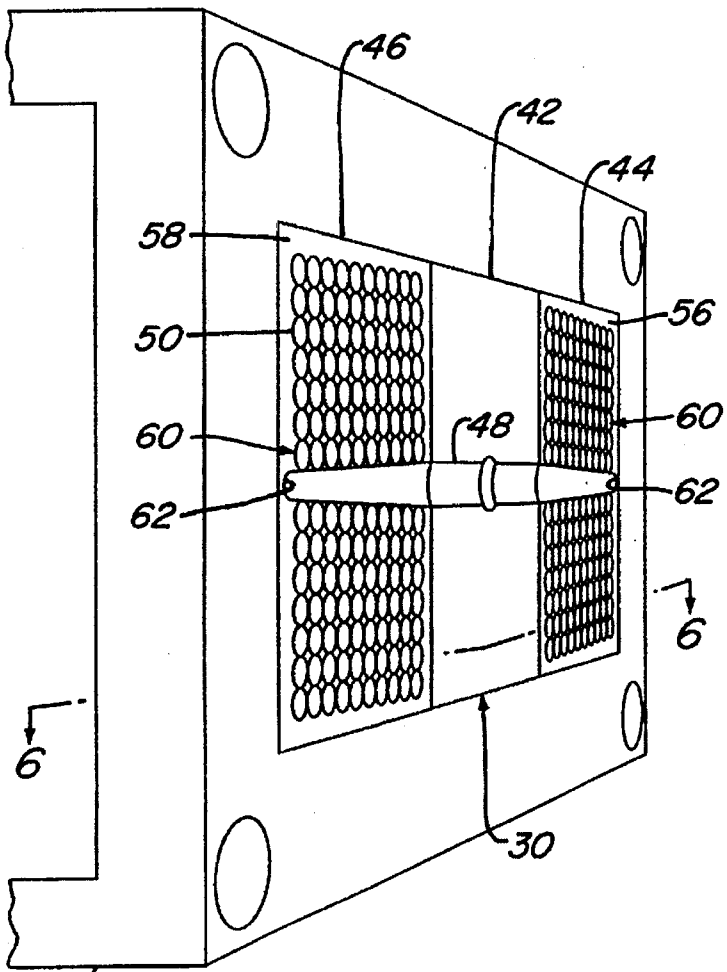

Referring now to FIGS. 2A–2B, the die halves 28, 30 and platens 30, 32 are shown in more detail. Each die half 28, 30 is made up of three inserts. Die half 28 has a center block insert 36, and two die inserts 38, 40. Die half 30 has a runner block insert 42, and two die inserts 44, 46. A runner 48 extends across runner block insert 42 and into die inserts 44, 46 of the movable die half 30, to allow the molten metal to travel from the sprue bushing 24, towards distal ends 62 of runner 48, and into the cavities 50. There is no runner in the center block insert 36 and die inserts 38, 40 of the stationary die half.

Platen 32 is a standard 5×8 inch platen of 1⅜ inch thickness, such as part number 58-13 from DME, Inc. of Madison Heights Mich., referred to by DME, Inc. as a mold plate. Platen 34 is a standard 5×8 inch platen with a support plate thickness of 1⅝ inches, such as part number 15-58 from DME, Inc., referred to by DME, Inc. as an ejector housing. These platens 32, 34 are just standard die casting platens that are then machined and modified to accept center block insert 36, runner block insert 42, and die inserts 38, 40, 44, 46, the ejector pins, ejector retainer plates, and other standard components. Die inserts 38, 40, 44, 46 are each 3 inches wide by 2.125 inches long (the length being the longitudinal direction of runner 48), and 1.0 inches thick. Die inserts 38, 40, 44, 46 are made of H13 steel.

Each die insert 38, 40, 44, 46 has a plurality of cavities 50. The cavities are located on the front surfaces 52, 54, 56, 58 of the die inserts 38, 40, 44, 46. The cavities are arranged in a plurality of rows 60 that are parallel to the edge of runner 48. On each die insert 44, 46, there are seven rows 60 of cavities on each side of runner 48. Each row 60 has ten cavities. Stationary die half 28 has cavities 50 that register with cavities 50 of the movable die half 30. Each die half 28, 30 has 280 cavities 50. When the die halves 28, 30 are in the closed position, the cavities in die inserts 38, 40 register with the cavities in die inserts 44, 46 thus forming voids 64 (shown in FIGS. 4 and 6) that define the parts to be cast.

Each cavity 50 is gated to each adjoining cavity, as further explained below. The rows of cavities 50 adjoining the runner 48 are also gated to the runner 48. The edges of runner 48 have a 2° taper, making runner 48 less wide at distal ends 62 than near the center.

Figure 3:
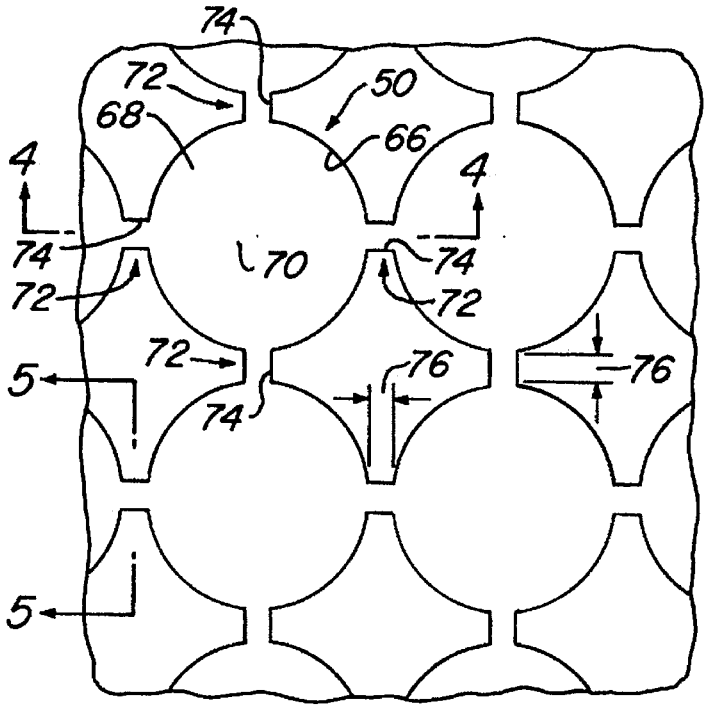
FIG. 3 is a top-view schematic of a portion of one of the die inserts of the present invention.

Referring now to FIG. 3, a top-view schematic of a portion of one of the die inserts 38, 40, 44, 46 is shown. Each cavity 50 has a rim 66, that defines an opening 68 of the cavity 50. The center of the opening is marked by numeral 70. Each cavity 50 is gated to adjoining cavities 50 by gates 72. Gates 72 are very short. Length 76 is in the order of about 0.002 inches. The gates allow the molten metal to flow between cavities 50, thus ensuring that each cavity 50 is completely filled with molten metal. Also, when the injected material hardens, the material in gates 72 forms a web between the cast parts that facilitates the removal of all the parts from the die halves 28, 30.

Figure 4:
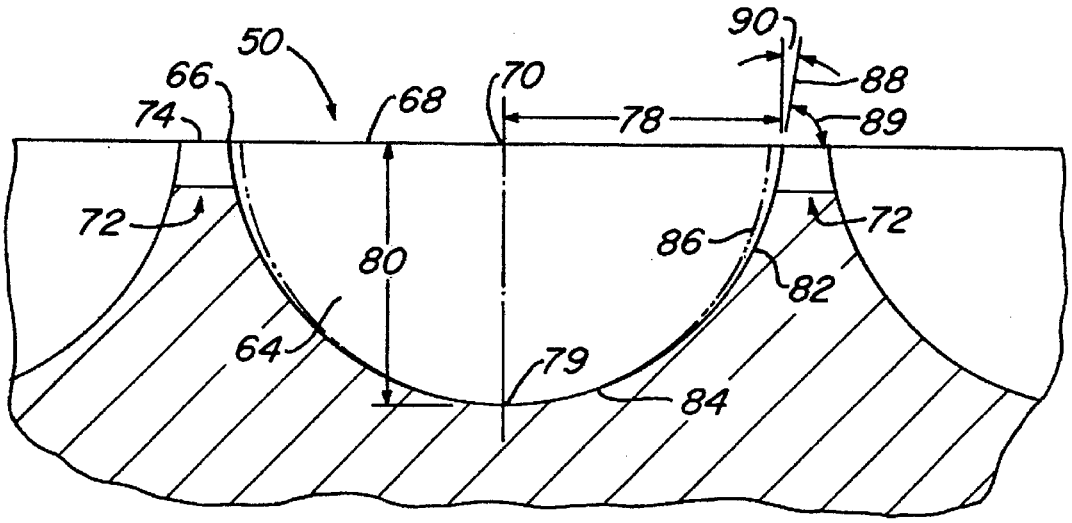
FIG. 4 is a cross sectional schematic view of a cavity of the present invention, taken along line 4—4 of FIG. 3.

Referring now mainly to FIG. 4, a cross sectional view of cavity 50, taken along line 4—4 of FIG. 3, is shown. In a conventional casting process, if a spherical part were desired, the cavities would likewise be spherical. In the present invention, however, although a spherical part is desired, cavity 50 is not spherical. Instead, the cavity is aspherical, as described below.

For a spherical cavity, the distance between the center 70 of the cavity opening 68 and rim 66 would be the same as the distance between center 70 and the bottom 79 of cavity 50. In the aspherical cavity of this invention, however, the distance 78 from center 70 to rim 66, is larger than distance 80 from center 70 to bottom 79. The upper portion 82 of cavity 50 has been enlarged to provide an enlarged opening 68. The lower portion 84 of cavity 50 is spherical. Dashed line 86 shows what a spherical cavity would look like, and helps to illustrate how upper portion 82 of cavity 50 has been enlarged.

For a spherical part of a desired diameter of 0.180 inches, dimension 78 is 0.090 inches, and dimension 80 is 0.088 inches. If cavity 50 were spherical in shape, dimension 78 would be the same as dimension 80, that is, 0.090 inches. Instead, lower portion 84 of cavity 50 is shaped like a sphere having a radius of 0.088 inches, and upper portion 82 is enlarged so that dimension 78 is 0.090 inches.

Also, the slope 89 of cavity 50 is such that it is never perpendicular to the front surface of the die insert, but is always at least a small angle 90 therefrom. For example, even at rim 66, the slope 89 of cavity 50 is less than 90° such that a line 88 in the plane of the cross section of FIG. 4 and tangent to the cavity wall at rim 66 is not perpendicular to the front surface of the die insert. Instead, a small angle 90 exists. This is in contrast to a spherical cavity, where if the cavity comprises exactly one-half of a sphere, line 88 would be perpendicular to the front surface of the die insert. The fact that line 88 is not perpendicular to the front surface of the die insert prevents the cast parts from becoming stuck in the cavities 50.

Figure 5:
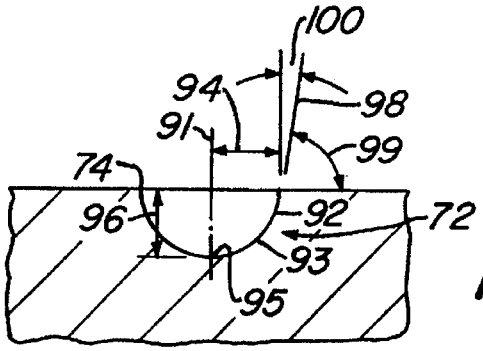
FIG. 5 is a cross sectional schematic view of a gate of the present invention, taken along line 5—5 of FIG. 3.

Referring now mainly to FIG. 5, a cross sectional view of a gate 72, taken along line 5—5 of FIG. 3, is shown. The cross-section of gate 72 is not circular in shape. Instead, upper portion 92 of gate 72 has been enlarged, so that the dimension 94 from the centerline 91 of gate 72 to the edge 74 of gate 72 is longer than the dimension from centerline 91 to bottom 95 of gate 72. The lower portion 93 of gate 72 is circular.

Dimension 94 is one third of dimension 78, and dimension 96 is one third of dimension 80. The slope 99 of gate 72 is similar to that of cavity 50 in that it is never perpendicular to the front surface of the die insert. For example, the slope 99 of gate 72 at edge 74 is similar to that of cavity 50 at rim 66 in that it is less than 90° so that a line 98 in the plane of the cross section of FIG. 5 and tangent to the gate wall at edge 74 is not perpendicular to the front surface of the die insert, but is instead at a small angle 100 from the perpendicular. This feature prevents the web formed between the cast parts from becoming stuck to gates 72.

Figure 6:
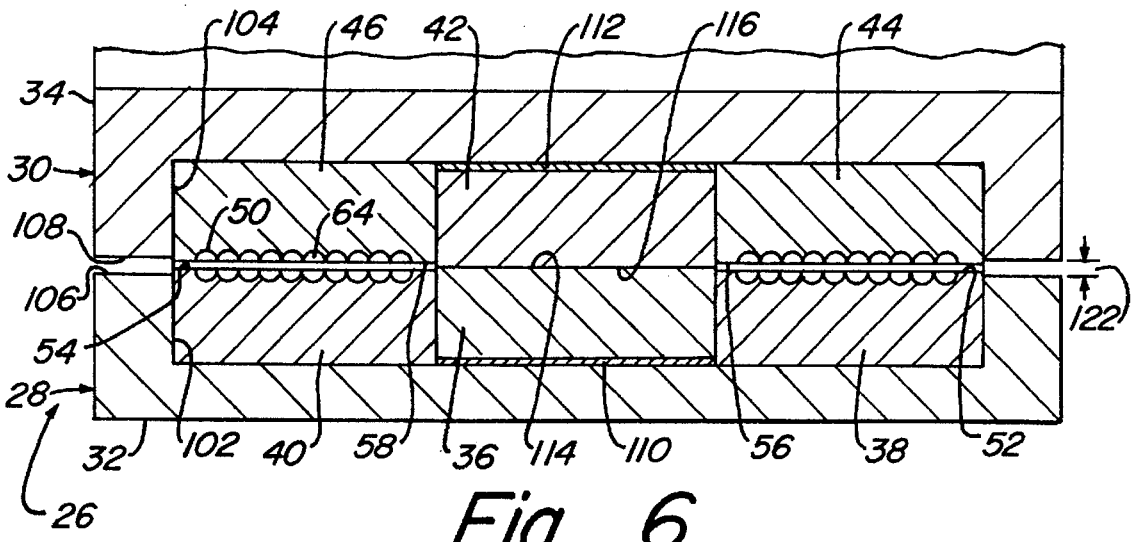
FIG. 6 is a cross sectional schematic view, taken along lines 6—6 of FIGS. 2A, 2B, showing the die halves in the closed position.

Referring now mainly to FIG. 6, a cross section is shown, taken along lines 6—6 of FIGS. 2A, 2B, that shows the die halves 28, 30 in the closed position. Recess 102 in platen 32 is sized to accommodate center block insert 36 and die inserts 38, 40. Recess 104 in platen 34 is sized to accommodate runner block insert 42 and die inserts 44, 46. Inserts 36, 38, 40, 42, 44, 46, are secured to platens 32, 34 by conventional means (not shown). The depth of recesses 102, 104 is such that die inserts 38, 40, 44, 46, protrude slightly above the upper surfaces 106, 108 of platens 32, 34. A spacer 110, is located below center block 36 so that center block 36 protrudes above die inserts 38, 40. A spacer 112, is located below runner block 42 so that runner block 42 protrudes above die inserts 44, 46. The thickness of each of spacers 110, 112 is in the order of 0.001 inch.

Because of spacers 110, 112, when die halves 28, 30 are in the closed position, mating surface 114 of center block 36 and mating surface 116 of runner block 42 come into contact, and front surfaces 52, 54 of die inserts 38, 40 are maintained spaced apart from front surfaces 56, 58 of die inserts 44, 46. Thus a spacing 122 equal to the total thickness of the two spacers 110, 112 results between the two die halves 28, 30. Spacing 122 results in a laminar void that connects cavities 50.

In operation, the apparatus of the present invention functions as follows. Each die casting cycle comprises several steps. In the "locking-down" step of the cycle, the stationary die half 28 and movable die half 30 come together and are locked in position.

Once the die halves 28, 30 are locked in position, the "injection" step begins. In the injection step, the plunger 18 is forced down cylinder 16 thus forcing molten metal through the gooseneck 20, the nozzle 22, the sprue bushing 24, and into the runner 48. From runner 48, the molten metal enters the first rows of cavities 50 that are gated to runner 48, and from there the molten metal propagates through the remaining cavities 50 by means of gates 72. The injection step takes about 1.0 seconds. Once the metal solidifies in the die, the metal that solidifies in gates 72 forms a web between the metal solidified in cavities 50. This web helps to maintain the cast parts together, thus increasing the chance that all the parts properly eject from die 26.

Spacing 122 also helps in the propagation of the molten metal, although that is not the purpose of spacing 122. Cavities 50 can be properly filled with molten metal even in the absence of spacing 122. The purpose of spacing 122 is to further assist in keeping the parts together during the opening step of the casting cycle. The metal that solidifies in the laminar void formed by spacing 122 results in a flashing between the parts that are formed in cavities 50. This flashing keeps the cast parts together much more efficiently than would just the web formed by the metal that solidifies in gates 72. When parts are cast without spacing 122 (which can be achieved by removing spacers 110, 112), in which case only the web formed by gates 72 holds the cast parts together, only about 25% percent of the cast parts properly release from the die. Instead, when spacing 122 is used, ejection of the cast parts from the die easily exceeds 75%.

In casting parts from conventional die casting materials, an injection pressure of about 400 psi is used. To die cast bismuth alloys, however, a higher pressure is used, about 800 psi, because the injection step must be completed in a short period of time because of the fast cooling characteristics of bismuth alloys. A flow control valve is added to better control the release of the pressure. Also, an accumulator is used to sustain the injection pressure throughout the stroke of plunger 18. An accumulator pressure of about 750 psi is used.

Once plunger 18 has completed the downward portion of its stroke, plunger 18 is raised, thus sucking molten metal 12 from melting pot 10 in preparation for the next cycle.

The "chill" step of the cycle is next. In the "chill" step, the die halves 28, 30 are kept in the locked position while the metal in the die cavities cools down enough so that at least the outer layer of the parts is hardened. Because of the fast cooling rate of bismuth alloys, the chill step lasts only between 1.3 and 1.8 seconds. If the chill step is too short, the cast parts will not have cooled enough, and will therefore probably split when die halves 28, 30 are opened. If the chill step is too long, the cast parts will have cooled too much, and can stick to the incorrect die half 28, or can excessively stick to the correct die half 30.

The next portion of the cycle is the "opening" step, in which the die halves 28, 30 are separated. For the casting operation to be successful, the parts should stick to the movable die half 30. This is so because the ejector pins (not shown) are generally located on the movable die half 30. Thus, if the parts stick to the movable die half 30, as the mold halves 28, 30 separate, the ejector pins force the parts out of the movable die half 30. If, on the other hand, the parts stick to the stationary die half 28, because there are no ejector pins on the movable die half 28, manual removal of those parts becomes necessary, thus preventing the automation of the die casting process.

The web and flashing between the cast parts also comes into play in this step of the casting cycle. Because the cast parts are tightly held together by the web and flashing, fewer ejector pins are necessary. Because of the large number of cavities 50 in the die, it would be extremely difficult to adapt each cavity with a separate ejector pin. When dealing with parts having a diameter in the order of less than 0.250 inches, it is much easier to manufacture a die with only about ⅛ to ⅕ the number of ejector pins as there are cavities 50. Because of the web and flashing, even with ejector pins on only a fraction of the cavities 50, the majority of the cast parts are ejected from the die.

After ejection, the cast parts are placed in a tumbler. Because of the brittleness of the bismuth alloy, the web and flashing break off from the cast parts, leaving the cast parts in their intended shape. The breaking-off of the web and flashing can be enhanced by adding steel balls in the tumbler. Steel balls of approximately ⅜ inch diameter have been found to work well.

The final step of the casting cycle is the "re-cycle" step. During this step the die halves 28, 30 are left in the open position and allowed to cool for about 1.7 to 2.1 seconds. To promote the necessary temperature difference between the movable die half 30 and the stationary die half 28, die halves 28, 30 are sprayed with a release agent. The face of the movable die half 30 is sprayed for 0.5 to 1.0 second with a #3 fan nozzle available from Shamrock Spray Accessories. The face of the stationary die half 28 is sprayed for 0.5 to 1.0 second with a #2 fan nozzle from the same vendor. The sprue bushing 24 is sprayed directly for 1.0 to 1.5 seconds with a #0 round nozzle from the same vendor. The #3 fan nozzle sprays more release agent than the #2 fan nozzle, thus cooling the movable die half 30 more than the stationary die half 28. This difference in temperatures between the mold halves is necessary to cause the parts to stick to the movable die half 30 instead of the stationary die half The mold release agent comprises one part chemical #5001 by Cross Chemical Company, Inc. of Detroit, Mich., 50 parts water, and one part WD-40. Ice is also added to the mixture to make it cold.

The recycle periods and the spray durations are critical in ensuring that the die halves 28, 30 are at the correct temperature and with the correct temperature differential between the two die halves 28, 30. If the die halves 28, 30 are too hot on the next cycle, the parts being cast will split; if the die halves 28, 30 are too cold on the next cycle, the parts being cast will not consistently stick to the movable die half 30, and the parts that stick to the movable die half 30 may not eject properly. If the temperature differential between the die halves 28, 30 is too low, parts may stick to the stationary die half 28. If the temperature differential is too high, the parts being cast will either split, or not properly eject from the movable die half 30.

All the above parameters, such as injection pressure, duration of chill step, duration of recycle step, and duration of the spraying during the recycle step are carefully selected for each particular part being cast, and are controlled by electronic controls that control the hydraulic system that in turn controls the casting equipment.

In addition to the part described above, a wide array of parts can be made with the apparatus and method of the present invention. Two other parts that are in high demand have been made with success, and a brief description of the parameters for those parts follows. The first part is a sphere of 0.150 inch diameter, which corresponds to #2 shot. For such a part, dimension 78 would be 0.075 inch, dimension 80 would be 0.073 inch, the injection would last about 1.0 seconds, the chill step would be about 1.5–1.9 seconds, and the recycle would be about 1.8–2.4 seconds. The other part is a sphere of 0.130 inch diameter, which corresponds to #4 shot. For such a part, dimension 78 would be 0.065 inch, dimension 80 would be 0.063 inch, the injection would last about 1.0 second, the chill step would be about 1.2–1.9 seconds, and the recycle step would be about 1.3–1.9 seconds.

While the invention has been particularly shown and described with reference to a preferred embodiment, it will be understood by those skilled in the art that various changes in form and detail may be made therein without departing from the spirit and scope of the invention.

What is claimed is:

1. A die for die casting substantially spherical objects of a material that expands when transitioning from the liquid to the solid state, the die comprising:

first and second die halves, each die half having a plurality of cavities that, when the die halves are in a closed position, align with the cavities in the other die half, thus defining a plurality of voids that define the objects to be formed; and each cavity having a slope that is at all points smaller than 90° from a front surface of the die half, thus reducing the sticking of the objects to the die halves.

2. The die according to claim 1 wherein the material that expands when transitioning from the liquid to the solid state is a bismuth alloy.

3. The die according to claim 1 wherein each cavity has a rim at a front surface of the die half, the rim defining an opening of the cavity, and wherein each cavity is aspherical in that a distance from the center of the opening to the rim is greater than the distance from the center of the opening to a bottom of the cavity, thus facilitating the removal of the objects from the die.

4. The die according to claim 1 wherein the first and second die halves cooperate such that, when in the closed position, front surfaces of the die halves are maintained at a selected spacing so as to define a laminar void connecting the cavities, thus resulting in flashing connecting the objects and facilitating the removal of the objects from the die.

5. A die for die casting substantially spherical objects of a material that expands when transitioning from the liquid to the solid state, the die comprising:

first and second die halves, each die half having a plurality of cavities that, when the die halves are in a closed position, align with the cavities in the other die half, thus defining a plurality of voids that define the objects to be formed;

each cavity having a rim at a front surface of the die half, the rim defining an opening of the cavity; and each cavity being aspherical in that a distance from the center of the opening to the rim is greater than a distance from the center of the opening to a bottom of the cavity, thus facilitating the removal of the objects from the die.

6. The die according to claim 5 wherein the material that expands when transitioning from the liquid to the solid state is a bismuth alloy.

7. The die according to claim 5 wherein the first and second die halves cooperate such that, when in the closed position, the front surfaces of the die halves are maintained at a selected spacing so as to define a laminar void connecting the cavities, thus resulting in flashing connecting the objects and facilitating the removal of the objects from the die.

8. A die for die casting substantially spherical objects of a material that expands when transitioning from the liquid to the solid state, the die comprising:

first and second die halves, each die half having a front surface, and a plurality of cavities located along the front surface that, when the die halves are in a closed position, align with the cavities in the other die half, thus defining a plurality of voids that define the objects to be formed;

each cavity having a slope that is at all points smaller than 90° from a front surface of the die half, thus reducing the sticking of the objects to the die halves;

the first and second die halves cooperating such that, when in the closed position, the front surfaces of the die halves are maintained at a selected spacing so that the front surfaces define a laminar void connecting the cavities, thus resulting in flashing connecting the objects end facilitating the removal of the objects from the die.

9. An improved hot chamber die casting machine for die casting substantially spherical objects of a material that expands when transitioning from the liquid to the solid state, the machine comprising in combination:

a pot that holds molten material;

a plunger and a cylinder for injecting the molten material into a die, the cylinder being in selective communication with the pot;

the die being in selective fluid communication with the cylinder;

the die comprising first and second die halves that are movable between and open an a closed position, each die half having a plurality of cavities that, when the die halves are in a closed position, align with the cavities in the other die half, thus defining a plurality of voids that define the objects to be formed; and each cavity having a slope that is at all points smaller than 90° from a front surface of the die half, thus reducing the sticking of the objects to the die halves.

10. The machine according to claim 9 wherein the material that expands when transitioning from the liquid to the solid state is a bismuth alloy.

11. The machine according to claim 9 wherein each cavity has a rim at a front surface of the die half, the rim defining an opening of the cavity, and wherein each cavity is aspherical in that a distance from the center of the opening to the rim is greater than the distance from the center of the opening to a bottom of the cavity, thus facilitating the removal of the objects from the die.

12. The machine according to claim 9 wherein the first and second die halves cooperate such that, when in the closed position, front surfaces of the die halves are maintained at a selected spacing so as to define a laminar void connecting the cavities, thus resulting in flashing connecting the objects and facilitating the removal of the objects from the die.

* * * * *

Adverse Decisions In Interference

Patent No. 5,632,322, Jerry E. Trickel, Lyn O. Trickel, DIE CASTING APPARATUS FOR CASTING SMALL PARTS FROM MATERIALS THAT EXPAND WHEN TRANSITIONING FROM THE LIQUID STATE TO THE SOLID STATE, Interference No. 103,972, final judgment adverse to the patentees rendered March 30, 2001, as to claims 1-12.

*(Official Gazette July 31, 2001)*